United States Patent [19]

Reinholtz

[11] Patent Number: 4,998,942

[45] Date of Patent: Mar. 12, 1991

[54] SNUBBER PROFILE

[75] Inventor: Charles F. Reinholtz, Blacksburg, Va.

[73] Assignee: Milliken Research Corporation, Spartanburg, S.C.

[21] Appl. No.: 457,850

[22] Filed: Dec. 27, 1989

[51] Int. Cl.[5] ..... D02J 1/22

[52] U.S. Cl. ..... 28/245; 242/147 R; 242/153; 242/155 R

[58] Field of Search ..... 57/91, 226, 310; 242/7.13, 147 R, 153, 154, 155 R; 28/245

[56] References Cited

U.S. PATENT DOCUMENTS

| | | | |
|---|---|---|---|
| 1,898,085 | 2/1933 | Dreyfus et al. | 57/91 |
| 2,582,639 | 1/1952 | Ljungberg | 242/153 |
| 3,223,351 | 12/1965 | Lemarchand | 242/154 |
| 3,561,045 | 2/1971 | Heffernan | 57/91 |
| 3,677,481 | 7/1972 | Haley et al. | 242/18 R |
| 3,720,070 | 3/1973 | Raves | 405/175 |
| 3,851,839 | 12/1974 | Hynes | 242/147 R |
| 3,874,153 | 4/1975 | Kawasaki et al. | 57/91 |
| 4,054,235 | 10/1977 | Witcher | 226/200 |
| 4,058,245 | 11/1977 | Hurt et al. | 226/174 |
| 4,060,964 | 12/1977 | Eaves | 57/291 X |
| 4,461,740 | 7/1984 | Koschinek et al. | 28/245 X |
| 4,916,783 | 4/1990 | Hayewood et al. | 28/245 X |

FOREIGN PATENT DOCUMENTS

| | | | |
|---|---|---|---|
| 569233 | 11/1957 | Italy | 242/7.13 |

*Primary Examiner*—Werner H. Schroeder
*Assistant Examiner*—Bradley Kurtz DeSandro
*Attorney, Agent, or Firm*—Earle R. Marden; H. William Petry

[57] ABSTRACT

A system to texturize partially oriented yarn in which the yarn is wrapped around a logarithmic spiral shaped hot draw pin to draw the yarn before the texturing thereof. The shape of the hot draw pin provides even distribution of normal force on the surface of the draw pin.

5 Claims, 3 Drawing Sheets

SNUBBER PROFILE

This invention relates generally to an improved snubber device to provide more uniform wear and thereby reduce excessive and local wear thereon which requires frequent replacement of the snubber to provide a quality product.

In particular, the invention is directed to a new and novel hot draw pin for use in a texturing system to draw POY yarn prior to introduction in an air texturing device.

Generally speaking the herein-disclosed invention relates to a snubber or snubbing device to create frictional drag on a rope, belt, sheet of material, yarn, etc. to provide desired tension in the product passing over and/or around the snubber or snubbing device. These devices tend to wear unevenly due to unequal normal forces thereon at spaced points of the device resulting in frequent replacement thereof. This has been found to be especially true in yarn texturing systems wherein synthetic yarns are wrapped around a chrome plated aluminum heated draw pin for the purpose of drawing a POY yarn prior to the texturing thereof.

Therefore, it is an object of the invention to provide a snubber or snubber device which has a shape or configuration so that the normal force on the surface of the device, created by the rope, yarn, etc. passing thereover or around, is substantially equal throughout the snubbing surface contacted by the rope, yarn, etc. passing thereover.

Other objects and advantages of the invention will become readily apparent as the specification proceeds to describe the invention with reference to the accompanying drawings, in which.

Basically the invention is directed to providing a snubber with a shape that equalizes the normal forces on the surface thereof to reduce the unequal wear thereon to extend the service life thereof. For the sake of discussion the snubber is fixed and a rope or yarn is at least partially wrapped therearound. The rope or yarn thereabout can make a partial wrap or several wraps therearound. As is well known the tension in the rope or yarn increases exponentially with the wrap angle as expressed in the following formula:

$$T_2 = T_1 e^{f\phi}$$

where $T_2$ = tension after the snubber $T_1$ = tension entering the snubber e = 2.718 (natural logarithm base)

f = coefficient of friction of snubber surface $\phi$ = the angle of wrap in radians Since the values of $T_1$, $\phi$ and f are always greater than zero, this equation shows the majority of frictional drag occurs near the exit point of yarn from the snubber device.

To understand the invention the relationship between tension, surface shape of the snubber and the force per unit length exerted by the rope or yarn on the snubber must be understood. The following equation defines this relationship:

$$n = \frac{T}{R}$$

where n = the normal force on the snubber

T = tension

R = radius of curvature

Then since the tension increases exponentially as the wrap angle increases it can be seen that the radius of the curvature (R) to maintain constant normal force is as follows:

$$R = Ke^{f\phi}$$

wherein K is a constant.

This radius of curvature in the above equation results in the exponential curve (often called the logarithmic spiral).

Thus it can be seen that, if it is desired to maintain the normal force expected by the rope or yarn on the surface of the snubber substantially constant to even out the wear thereon, the radius of curvature of the snubber should be in the shape of an exponential or logarithmic spiral curve.

Figure 4:
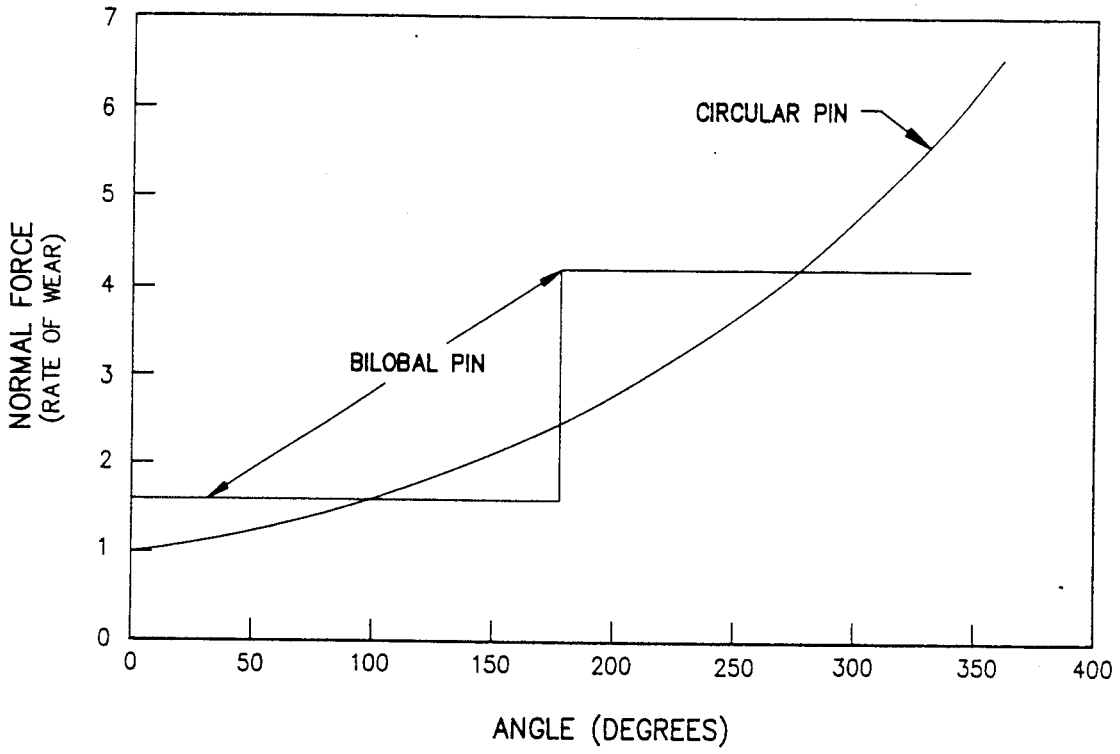
FIG. 4 is a graphic representation of the current snubber used in the process of FIG. 1 versus the improved snubber shown in FIGS. 1-3.
Figure 5:
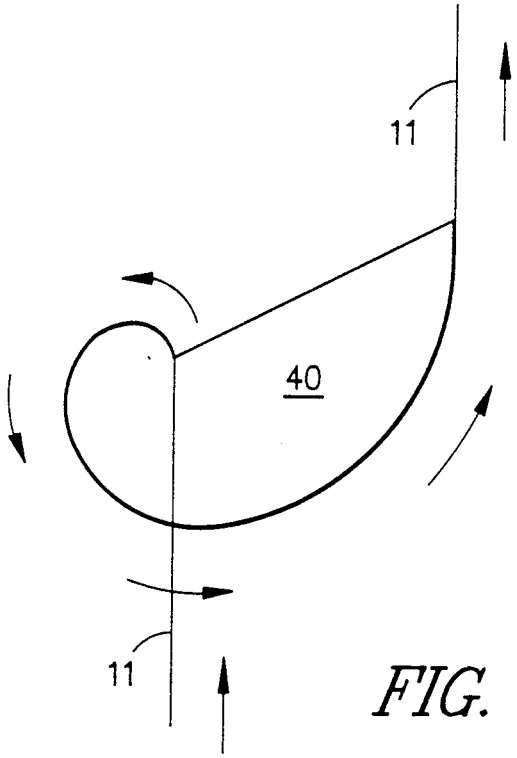
FIG. 5 is a modification of the snubber shown in FIGS. 1-3.
Figure 6:
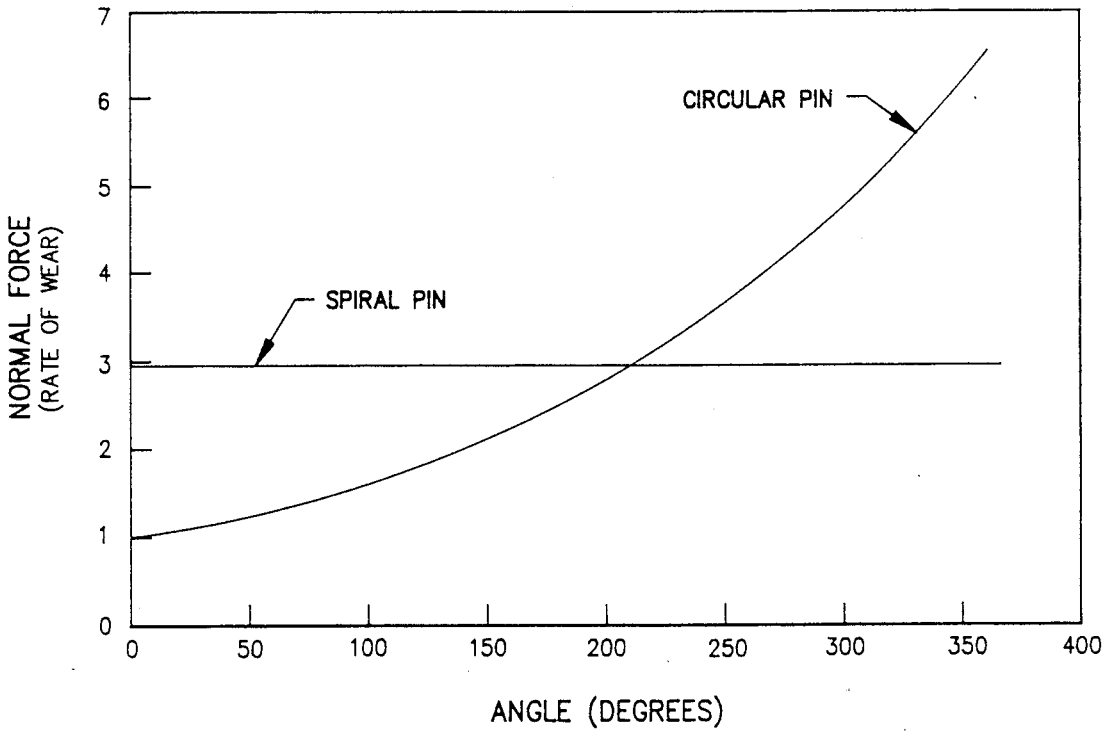
FIG. 6 is a graphic representation of the snubber shown in FIG. 5.

The ideal shape would be a single logarithmic spiral such as shown in FIGS. 5 and 6 of the drawing but in practice for the intended use in FIGS. 1-4, the snubber is bilobal and the equations for both sections of the snubber is the same. The snubber could employ a multiplicity of lobes but, as the number of lobes increases, the snubber approaches a circular shape which has the problems currently encountered and resolved by this invention.

Figure 1:
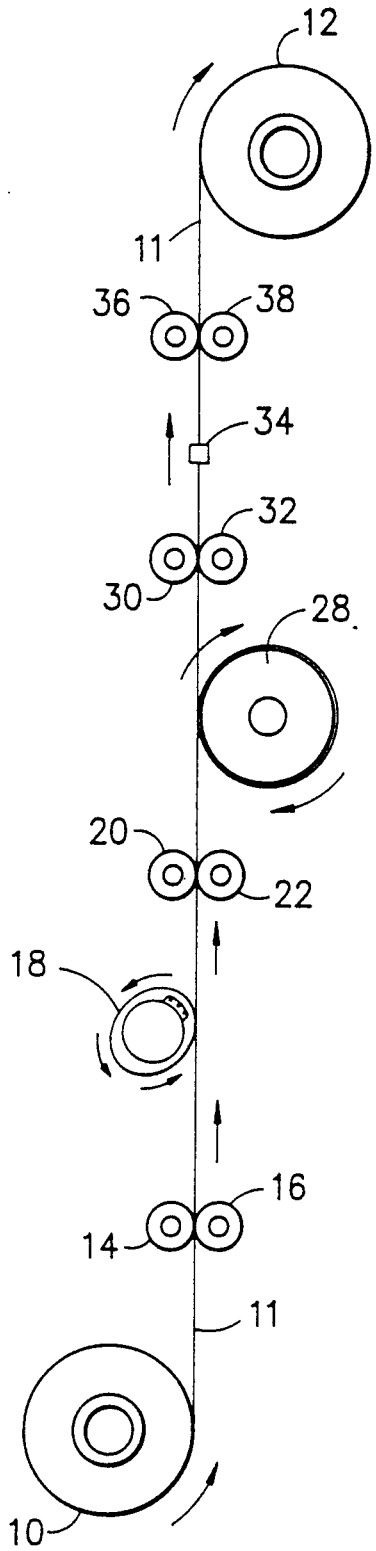
FIG. 1 is a schematic representation of the preferred use of the herein-disclosed snubber.
Figure 2:
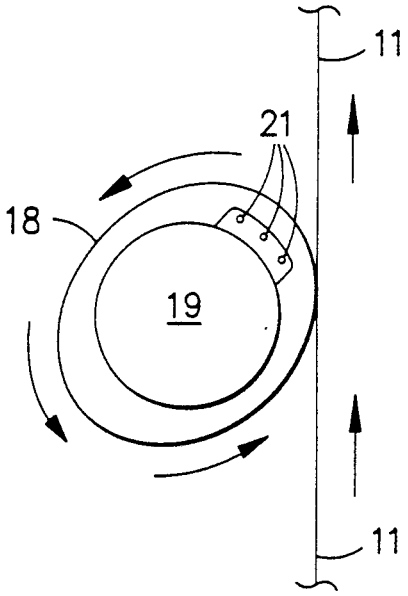
FIG. 2 is a blow-up view of the snubber shown in FIG. 1.
Figure 3:
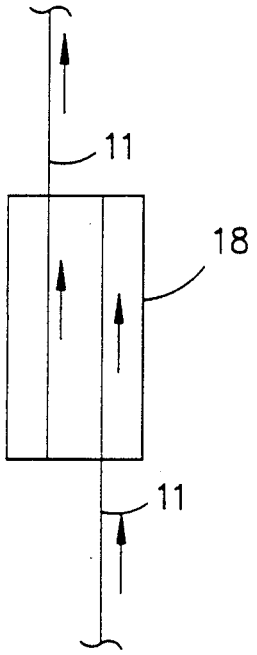
FIG. 3 is side view of the snubber shown in FIGS. 1 and 2.

Looking now to the drawings and especially FIG. 1 the invention will be described. The reference number 10 represents a yarn package of DuPont 240/54-693T POY yarn which is to be drawn, textured and taken up as 1/150/54-693T yarn on the package 12. The yarn 11 is delivered by the rolls 14, 16 to the heated draw or snubber pin 18, heated to about 100° C., at the rate of approximately 250 meters/minute. Since the rolls 20, 22 are delivering yarn 11 at a rate of approximately 445 meters/minute the yarn is drawn between the heated draw or snubber pin and the rolls 20,22. From the rolls 20,22 the drawn yarn is wrapped around the pin 18, heated to a temperature of about 140°, and allowed to relax since the rolls 30, 32 are delivering yarn ar a rate of 430 meters/minute. From the rolls 30, 32, the yarn 11 passes through a conventional air texturing nozzle 34, operating with air at a pressure of 140 p.s.i., wherein it is air textured. From the air texturing jet, the yarn 11 is delivered to the take-up package 12 by the rolls 36, 28 driven at a suitable desired speed. The draw pin or snubber 18 shown in detail in FIGS. 2 and 3 has a suitable heater 19 mounted in the center thereof by suitable means 21, such as pins, rivets, etc. to heat the snubber 18 so as to soften the yarn 11 passing thereover as it is drawn by the rolls 20, 22.

In all forms of the invention the snubber is fixed and the material in contact therewith passes over and in contact therewith in the forms of the invention shown in FIGS. 1–6. The snubber is preferably chrome plated aluminum, which prior to this invention had to be replaced every two to five weeks due to excessive wear in spots , especially at the outlet point of the yarn from the snubber.

Looking at the graph in FIG. 4 it can be seen that normal force on each of the lobes of the snubber 18 is substantially constant except that the wear on the lobe adjacent to the outlet point of the yarn 11 is greater than the wear on the lobe initially contacted by the yarn 11. Even though this is true it can be seen that the overall normal wear is less than that of a circular pin having the same surface coefficient of friction.

FIGS. 5 and 6 represent the ideal snubber where, as is shown in FIG. 5, the snubber 40 has a single logarithmic spiral and, as shown in FIG. 6, the normal force on the entire surface is the same and substantially below that of a circular pin.

It can be seen that the exponential or logarithmic curved shape of the snubber provides a snubber wherein the normal force on wear on the surface thereof is substantially reduced and more even resulting in a longer service life for the snubber. This results in lower labor costs due to a longer period between change and longer machine operating periods. This longer operating period is more efficient since the amount of yarn lost on start-up and shut-down of the equipment is less.

Although the preferred embodiments of the invention have been described, it is contemplated that changes may be made without departing from the scope or spirit of the invention and it is desired that the invention be limited only by the scope of the claims.

I claim:

1. A system to texturize partially oriented synthetic yarn comprising: a first means to supply a partially oriented yarn at a first rate to a heated rigid, non-flexible snubber, a second means operably associated with said snubber drawing the yarn from said snubber at a rate substantially higher than the rate of said first means whereby the yarn is drawn between said snubber and said second means and a third means receiving yarn from said second means to texturize and take up the yarn delivered by said second means, said snubber having an external surface in the shape of a logarithmic spiral.

2. The system of claims 1 wherein said snubber is in the shape of a bilobal logarithmic spiral.

3. A rigid, non-flexible snubber device to provide drag to a material being transported thereover comprising; a snubber having an external surface, said external surface being in the shape of a logarithmic spiral.

4. The device of claim 3 wherein the logarithmic spiral is bilobal.

5. The method of drawing partially oriented yarn by passing the yarn over a heated rigid, non-flexible snubber device comprising the steps of: supplying a partially oriented synthetic yarn at a fast rate, passing the supplied yarn in a logarithmic spiral path around the snubber device and drawing the yarns from the snubber device at a rate greater than the first rate to thereby draw the yarn.

* * * * *

UNITED STATES PATENT AND TRADEMARK OFFICE

CERTIFICATE OF CORRECTION

PATENT NO. : 4,998,942

DATED : March 12, 1991

INVENTOR(S) : Charles F. Reinholtz

It is certified that error appears in the above-identified patent and that said Letters Patent is hereby corrected as shown below:

Claim 3, Column 4, line 19 after "A" delete "rigid, non-flexible"

Claim 3, Column 4, line 21 after "a" and before "snubber" insert --rigid, non-flexible--

Signed and Sealed this

Eighth Day of February, 1994

Bruce Lehman

*Attest:*

BRUCE LEHMAN

*Attesting Officer*

*Commissioner of Patents and Trademarks*